US005358737A

United States Patent [19]

Muës et al.

[11] Patent Number: 5,358,737

[45] Date of Patent: Oct. 25, 1994

[54] METHOD OF BRUSHING INCOMPLETELY DRIED COATING REGIONS FROM A COATED WEB

[75] Inventors: Willem Muës, Tremelo; Hendrik J. Geerts, Hulshout, both of Belgium

[73] Assignee: Agfa-Gevaert N. V., Mortsel, Belgium

[21] Appl. No.: 75,915

[22] Filed: Jun. 14, 1993

Related U.S. Application Data

[63] Continuation of Ser. No. 824,539, Jan. 23, 1992, abandoned.

[30] Foreign Application Priority Data

Feb. 20, 1991 [EP] European Pat. Off. ..... 91200362.1

[51] Int. Cl.[5] ..... B05D 3/12

[52] U.S. Cl. ..... 427/177; 427/271; 427/277; 427/278; 427/368

[58] Field of Search ..... 118/119, 665, 110, 114, 118/117; 427/9, 10, 368, 271, 177, 277, 278

[56] References Cited

U.S. PATENT DOCUMENTS

| | | | |
|---|---|---|---|
| 2,743,572 | 5/1956 | Hiensch | 427/368 |
| 3,908,588 | 9/1975 | Daunheimer et al. | 118/110 |
| 4,630,407 | 12/1986 | Rhodes | 427/368 |
| 4,704,803 | 11/1987 | Valentini | 34/9 |
| 4,941,865 | 7/1990 | Skudrzyk | 427/368 X |

*Primary Examiner*—Shrive Beck
*Assistant Examiner*—Benjamin L. Utech
*Attorney, Agent, or Firm*—William J. Daniel

[57] ABSTRACT

A coating system for applying to a face of a moving continuous web a coating of predetermined thickness of a liquid coating composition, thereafter drying the thus-coated web under substantially constant drying condition, and collecting the dried coated web on a take-up roll, is provided with an arrangement for removing from the coating any portions exceeding the predetermined thickness which would not be completely dried during drying and would adhere to and contaminate surfaces coming in contact therewith, such as guide roller surfaces or the adjacent windings on the take-up roll. The arrangement includes web wiping means for contacting excessively thick regions of the coating which is adapted to be displaced from an inoperative position remote from the web to an operative position contacting the excessively thick regions of the coating, the displacement being actuated in response to the detection on the web of excessively thick coating regions. The web wiping means is driven in its operative position in a continuous, e.g. circular, path having a locus intersecting the web path and preferably is a cylindrical brush of flexible bristles. The removed coating portions may be cleaned from the wiping means e.g. by a scraper and aspirated away by suction.

7 Claims, 3 Drawing Sheets

METHOD OF BRUSHING INCOMPLETELY DRIED COATING REGIONS FROM A COATED WEB

CROSS REFERENCE TO EARLIER APPLICATION

This application is a continuation of application Ser. No. 07/824,539, filed Jan. 23, 1992, now abandoned.

BACKGROUND OF THE INVENTION

1. Field of the Invention

This invention relates to a web handling method to prevent web drive components from becoming contaminated by insufficiently dried portions of the web.

2. Description of the Prior Art

In the manufacture of numerous products liquid compositions are coated on a continuous web. The coated surface of the web is then subjected to controlled temperatures and humidities to effect setting and drying. Depending on the particular path that the web must follow during processing, it may be necessary or expeditious for the web's coated surface to contact rollers which guide the web along a given path. In such processes, it is important that the web be completely dried prior to contacting a roller or windup to prevent roller or interweb contamination. If there are portions of the web that have not been completely dried, the rollers will be contaminated and will in turn contaminate subsequent sections of the web passing over them. If portions of the coated web are not completely dried when wound up, they can stick to the underside of the web that lies on top. In this way, large portions may become unacceptably contaminated.

This contamination is a particular problem in the manufacture of photographic materials where coating compositions are applied to various supports such as paper or film. In order to obtain the high coating speeds needed in today's competitive environment it is essential that the coating operation be a continuous uninterrupted process. This is obtained by the use of complex equipment which the trailing edge of one web to the leading edge of another web without stopping the web and its transport system. It is possible that the coating procedure may be disrupted when a splice passes the coating station. In general when a coating process starts or is disturbed the coating is nonuniform and includes thicker regions.

Since dryers are designed with a capacity adequate to dry the normal coating to the desired dryness, heavier or thicker web coatings due to start-up or disturbance of the process often are insufficiently dried.

Some known methods to alleviate this problem are the use of a suction device adjacent the coating apparatus which acts as a vacuum cleaner on demand to suction off excess fluid from the web surface. This, however, requires cleaning of the suction tube after each operation to ensure that there are no lingering specks particles of the coasting material which may dry out and impede the sectioning system.

In EP 0 254 306 a multi-roll web support arrangement is described which is adapted to evacuate the excess fluid from the web surface. This arrangement has some major disadvantages. When the set of rollers is rotated the path of the web changes and lengthens slightly. In order to deal with these variations in pathlength and tension on the web, the web handling device has to be made more complex. The outer surface of the blotting rollers has to be cleaned or changed after one or more operations. These disadvantages make the arrangement described not desirable in a modern and automatic production plant.

As an alternative, the drying capacity of the dryer could be increased to handle the excess material on the web. However, this is inefficient and can lead to excessive drying of a normal coating.

SUMMARY OF THE INVENTION

Objects of the Invention

It is an object of the present invention to provide an improved web handling method that prevents the web drive system from being contaminated by insufficiently dried portions of the web. It is a further object to provide a arrangement for carrying out such method that is simple of construction and easy to maintain.

Statement of the Invention

The roller or interweb contamination may be alleviated by the method of the invention which comprises the steps of: passing a moving coated web over a support, determining when nonuniformly coated portions of said moving web that will result in incompletely dried portions of the moving web pass over the support, and brushing the nonuniformly coated surface at least during the period the nonuniformly coated portions pass over said support, so as to remove, at least partially, said nonuniformly coated portions of said web.

In the act of brushing it is essential that there be a relative velocity difference between the brushing means and the coating to be brushed.

The brushing of the web can be done in the countercurrent direction relative to the web movement. The nonuniformly coated portions which are coated may be continuously evacuated.

In implementing the above method, a system may be employed comprising means for supporting a coated web, means for detecting when nonuniformly coated portions of the moving web that will result in incompletely dried portions of said web pass said support means, and brushing means which at least partially remove said nonuniformly coated portions of said web as such portions of the web pass over said support means.

The brushing of said system may be done countercurrent direction relative to the web movement. The nonuniformly coated portions removed by the brushing means may be continuously removed by evacuating means. The brushing means may be a cylindrical brush which extends over the total width of said web and which may rotate in the countercurrent direction relative to the web movement.

In order to remove from the brush the nonuniformly coated portions which have been removed from said web and adhere to said brush a knife may be positioned in contact with the hairs of said brush. The nonuniformly coated portions removed from the brush by the knife may be evacuated continuously.

Finally, in order to automate the operation of the system, means may be provided for generating a signal indicative of the passage of incompletely dried coating regions on the web past a support means and for displacing the brushing means from an inoperative position into operative contact with the web.

BRIEF DESCRIPTION OF THE DRAWINGS

The invention is described hereinafter by way of an example with reference to the accompanying drawings, wherein.

DETAILED DESCRIPTION OF THE INVENTION

Figure 1:
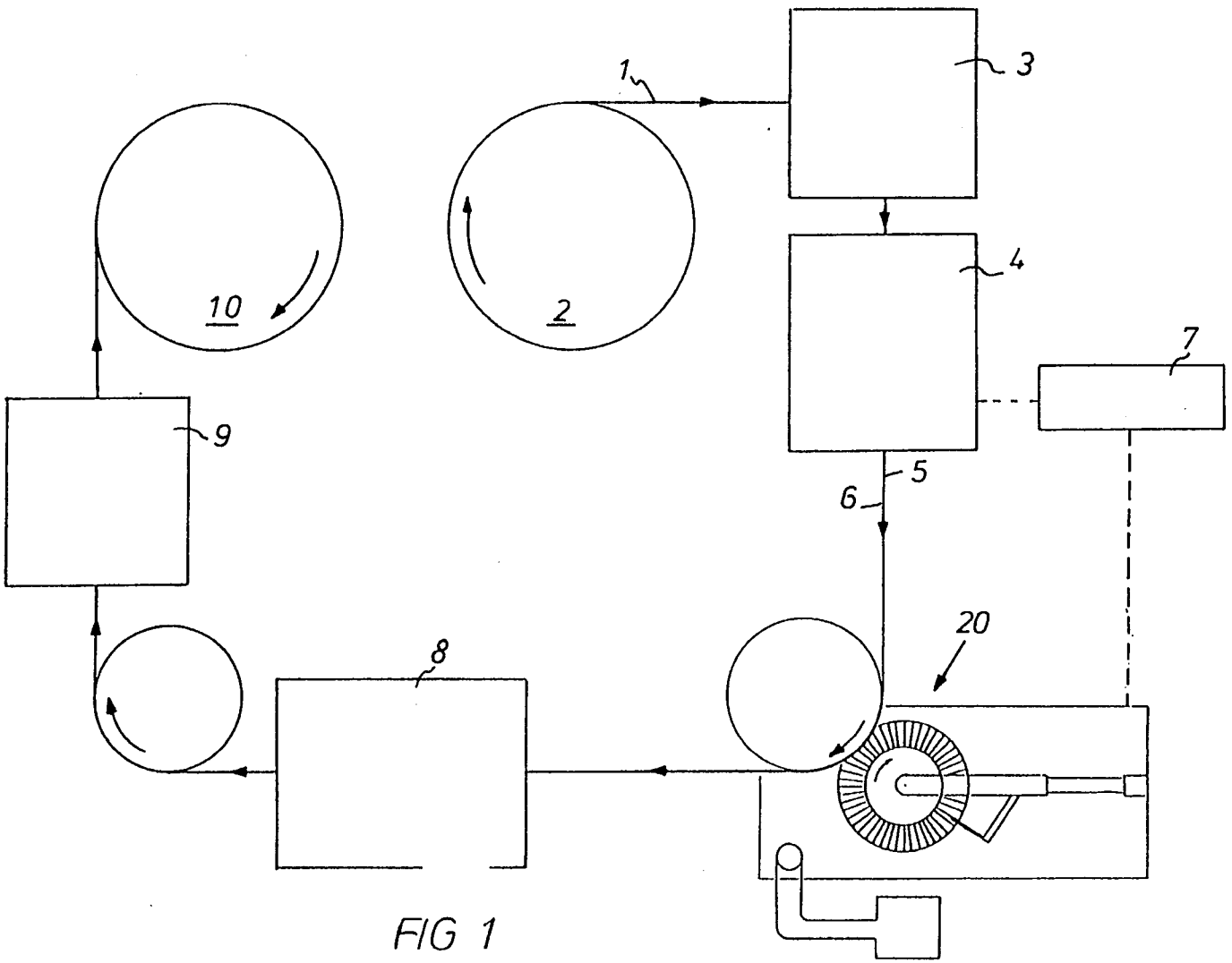
FIG. 1 is a diagrammatic illustration of a web handling system.

Referring to FIG. 1 there is shown in greatly simplified form a web handling arrangement. As may be seen a web 1 is unwound from a supply roll 2 and driven through a known web handling arrangement represented by block 3. This arrangement 3 contains the driving mechanism, arrangements to guide and direct the web 1, to control the lateral web position and the web tension. This arrangement 3 also contains known arrangements (not illustrated) to splice the trailing edge of one web to the leading edge of another web without stopping the web and its transport system. The web is driven through a coating and chilling station of conventional design generally represented by block 4.

The web 1 has an obverse surface 5 and a reverse surface 6. During the passage through the coating station 4 a liquid layer (or layers) is coated on the obverse surface. This obverse surface 5 is normally coated with a layer or layers of uniform thickness, however, at the start and the end of the process, when splices pass, and in general when any disturbance in web travel occurs, the coating is nonuniform and the surface 5 is locally covered with heavier or thicker layers. These nonuniformities will result in incompletely dried coated portions of web 1 and are detected by a controller 7 which is linked with a system represented by block 20 which removes, at least partially, the nonuniformly coated portions of the web 1. The web 1 is then driven through conventional drying and conditioning stations represented by block 8. again some web handling arrangements 9 which have the same function as arrangement 3, and finally is wounded around a roll 10. Web handling system 9 allows again changing of wound up roll without stopping the web or its transport system.

Figure 2:
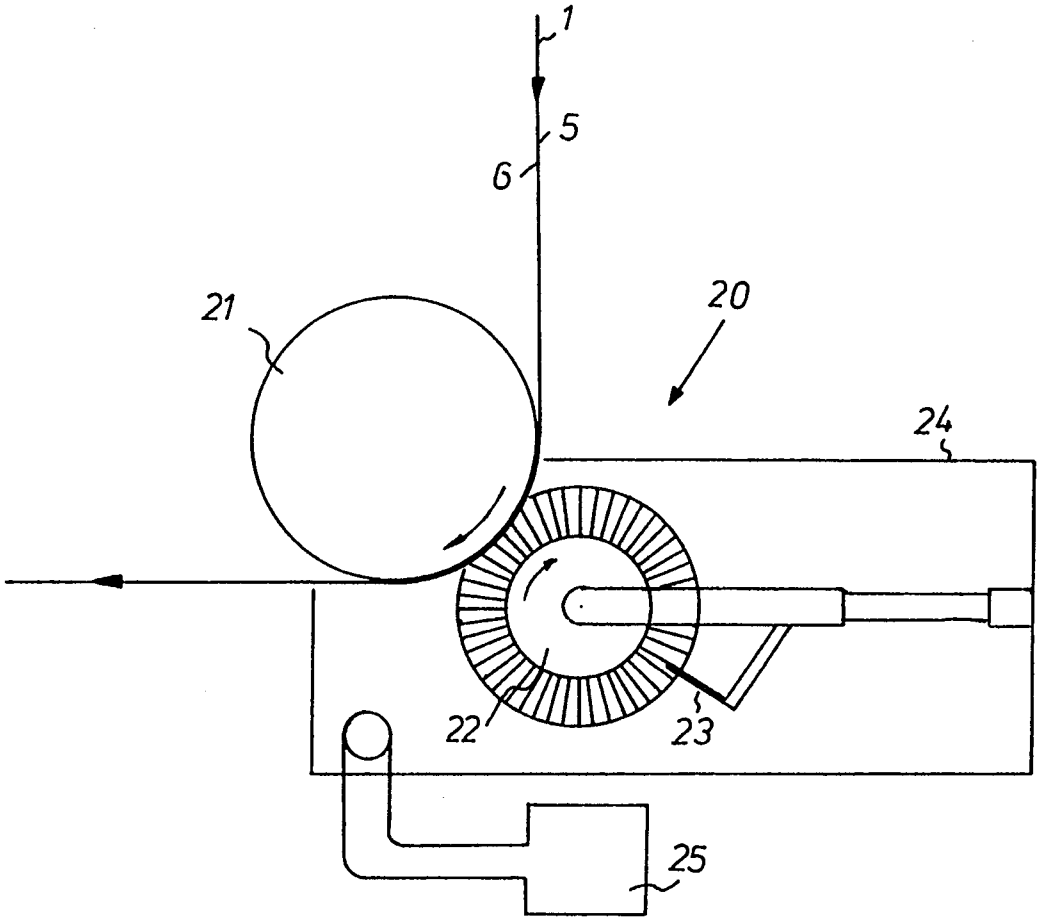
FIG. 2 is a diagrammatic illustration of a preferred embodiment of a brushing arrangement of said web handling system in operative position.

FIG. 2 is a detail view of brushing arrangement 20. Suppose at the start-up of a coating procedure, the deposited layer is being nonuniformly coated on the obverse surface 5 of the web 1. Controller 7, which is a process computer controlling the whole system detects the start of the coating procedure. Knowing the web-speed and weblength between brushing arrangement 20 and coating arrangement 4, controller 7 calculates the time needed for the nonuniformities of the coated material to reach support roller 21. Controller 7 gives a command to start the rotation of brush 22 which is a cylindrical brush extending over the total width of the web. Brush 22 is rotating in countercurrent direction relative to the web movement and is supported in an inoperative position where no contact with web 1 is made, as in FIG. 3. At the same time the air inside the box 24 is evacuated with a known ventilation device 25. Some seconds before the nonuniformly coated portions would reach the roller 21, controller 7 gives a command to displace rotating brush 22 towards roller 21. Brush 22 is then displaced to an operative position so that the web 1 pushes in the hairs of the brush for 1 to 4 mm.

When the nonuniformly coated portions reach roller 21 these portions are now being brushed off in such a way that the heavier or thicker portions are removed from web 1. If any nonuniformly coated portions stick to the web after being brushed, the thickness of these portions is reduced to a magnitude that can be sufficiently dried by drying arrangement 8.

Figure 3:
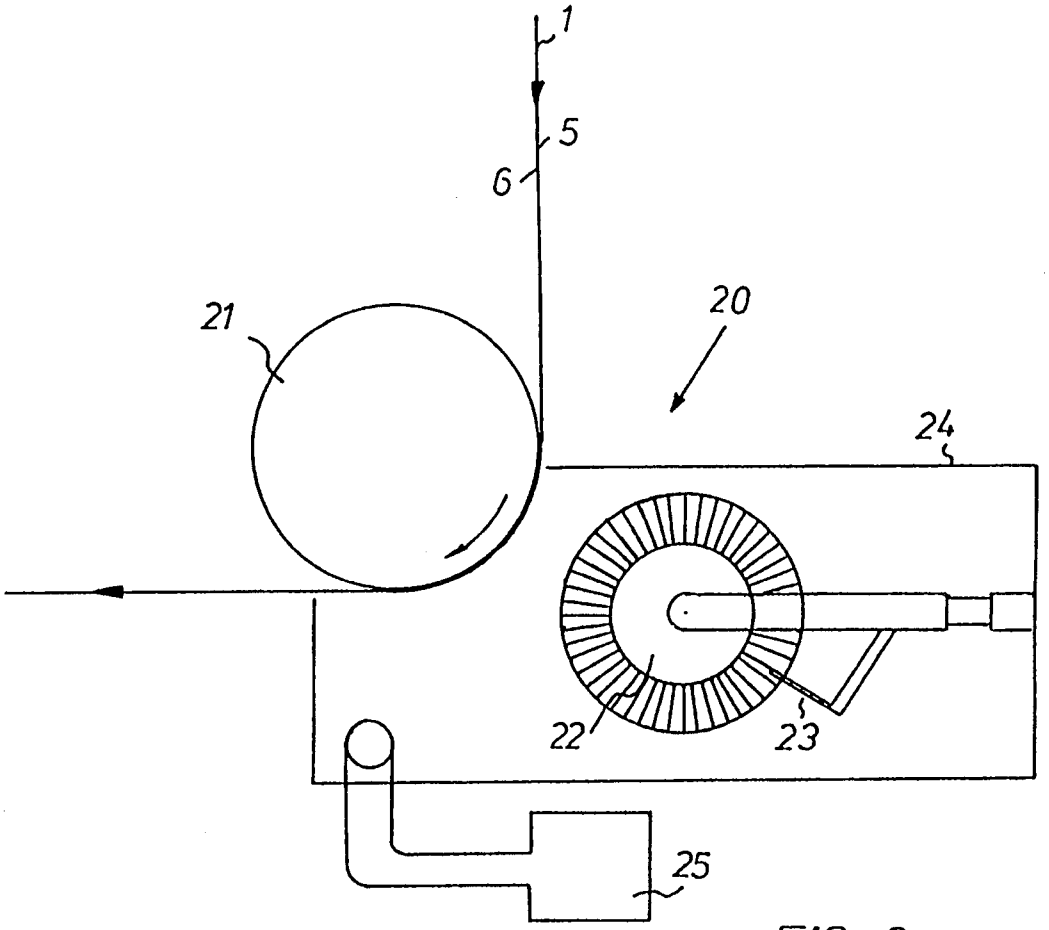
FIG. 3 is a diagrammatic illustration of a brushing arrangement of said web handling system in non-operative position.

A metallic knife blade 23 is positioned in the hairs of the brush for a depth not more than 2 mm (See FIG. 3). This knife blade has to remove the not fully dried coated portions which stick to the hairs of the brush.

Brush 22 and knife blade 23 are place inside a enclosure 24 which isolates the brush and the knife blade from the rest of the system. Inside this enclosure 24, the air is loaded with particles which formed the nonuniformly coating on the obverse surface of the web 5. This air is continuously sucked off or aspirated with a usual air evacuation means 25. Enclosure 24 and air evacuating means 25 are constructed so that no particles leave the area between enclosure 24 and web 1 on support 21, except those that are evacuated through the air evacuation means.

Some time, e.g. ten seconds, after brush 22 makes contact with web 1 controller 7 gives a command to withdraw the brush 22 from the web in its inoperative position where no contact with web 1 is made. Brush 22 stops rotating and 5 seconds later the evacuation of air ends. During the normal coating procedure the brush is withdrawen from the web as shown in FIG. 3.

The following data illustrate the described arrangement:

- total diameter of the brush 100 mm,
- smooth nylon hairs with a diameter abetween 0.15 and 1.5 mm and a length of 22 mm,
- brush density approximate 450 hairs/square centimeter, measured on the clamped end of the brush,
- speed of brush 900 rpm,
- speed of web 100 m/min.

The invention is not limited to the embodiment described hereinbefore. It is also possible to place the brushing arrangement 20 further downstream in the web handling system. For instance, the brushing arrangement 20 can be placed in the drying and conditioning arrangement 8, but before the coated obversde surface of the web 5 contacts any roller or is wound up. It is even possible to place the brushing arrangement 20 after the drying and conditioning arrangement 8, so that only the not completely dried portions are to be removed.

The brushing means can also be brushlike rollers covered with hairs made of other materials than plastics. The rollers can be covered with a foam structure, plush material or any other meterial that is capable of exerting a brushing action against the coating and thereby remove at least partially the nonuniformly coated portions of the coating from the web. It is a major advantage if these materials can be continuously cleaned by any means.

We claim:

1. In a method for coating a moving web in which a continuous web is advanced at a linear velocity from a supply roll through a coating station where a substantially uniform coating of a liquid coating composition having a thickness is applied to a face thereof, then through a drying station to dry the thus-applied coating on said advancing web, and finally to a take-up station for collection into a roll, in combination, the improvement of preventing contamination of surfaces coming in contact with an undried coated face of said web in the event of the presence on the coated web of nonuniformly coated regions due to temporary disturbance of the application of said coating, which comprises the steps of:

advancing the coated web prior to passage thereof through said drying station through a web brushing station containing web brushing means having a periphery defining a continuous path, when a disturbance in the coating application occurs, temporarily displacing said web brushing means in said web brushing station from a inoperative position separated from the coated web surface to an operative position where said periphery of the web brushing means makes contact with the undried coated face of said web at a locus along the path of the web, and driving the periphery of said web brushing means along said continuous path while in said operative position at a different linear velocity relative to the linear velocity of the coated web, whereby the web brushing means in said operative position at least partially removes said nonuniformly coated regions from the web face.

2. The method of claim 1 including the step of removing from the web brushing means any of the coating composition adhering thereto.

3. The method of claim 1 wherein the periphery of said web brushing means defines a circular path.

4. The method of claim 1 wherein said periphery of said web brushing means is driven along its continuous path in a direction which at said locus is countercurrent to the direction of movement of the web at said locus.

5. The method of claim 1 wherein said web brushing means comprises an array of flexible bristles extending generally transversely of the web substantially across the width thereof.

6. The method of claim 5 wherein said array comprises a generally cylindrical brush of said bristles having the axis thereof extending generally transversely of the web.

7. In a method for coating a moving web in which a continuous web is advanced at a linear velocity from a supply roll through a coating station where a substantially uniform coating of a liquid coating composition having a thickness is applied to a face thereof, then through a drying station to dry the thus-applied coating on said advancing web, and finally to a take-up station for collection into a roll, in combination, the improvement of preventing contamination of surfaces coming in contact with an undried coated face of said web in the event of the presence on the coated web of nonuniformly coated regions due to temporary disturbance of the application of said coating, which comprises the steps of:

advancing the coated web prior to passage thereof through said drying station through a web brushing station containing web brushing means having a peripheral surface adapted for contact with said face of said web, when a disturbance in the coating application occurs, temporarily displacing said web brushing means in said web brushing station from a inoperative position separated from the coated web surface to an operative position where said peripheral surface of the web brushing means makes contact with the coated web surface while driving said peripheral surface of said web brushing means at a different linear velocity from said linear velocity of said web, whereby the web brushing means in said operative position at least partially removes said nonuniformly coated regions from the web, and removing from the web brushing means any of the coating composition adhering thereto.

* * * * *